US006240890B1

(12) United States Patent
Abthoff et al.

(10) Patent No.: US 6,240,890 B1
(45) Date of Patent: Jun. 5, 2001

(54) STARTING DEVICE FOR AN INTERNAL COMBUSTION ENGINE AND METHOD FOR STARTING THE INTERNAL COMBUSTION ENGINE

(75) Inventors: Jörg Abthoff, Plüderhausen; Roland Kemmler; Klaus Magg, both of Stuttgart; Martin Matt, Bruchsal; Dittmar Wieland, Oppenweiler, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/433,437

(22) Filed: Nov. 4, 1999

(30) Foreign Application Priority Data

Nov. 12, 1998 (DE) ..... 198 52 085

(51) Int. Cl.[7] ..... F02N 11/00
(52) U.S. Cl. ..... 123/179.3; 290/38 R
(58) Field of Search ..... 123/179.3, 179.25; 290/38 R, 38 C

(56) References Cited

U.S. PATENT DOCUMENTS

| | | | |
|---|---|---|---|
| 4,662,233 | 5/1987 | Mazzorana | 74/7 A |
| 4,684,816 | 8/1987 | Mazzorana | 290/38 R |
| 5,095,864 | 3/1992 | Bolenz et al. | 123/179.1 |

FOREIGN PATENT DOCUMENTS

| | | |
|---|---|---|
| 89 14 904 U | 12/1989 | (DE) . |
| PCT WO 88/06238 | 8/1988 | (EP) . |
| 1199145 | 8/1967 | (GB) . |

OTHER PUBLICATIONS

European Search Report No. 99120729.1–1231, Feb. 17, 2000.

Patents Abstracts Of Japan, "Engine Starting Device", Appl. No. 57–193794, M–322 Sep. 4, 1984, vol. 8/No. 191.

*Primary Examiner*—Andrew M. Dolinar
(74) *Attorney, Agent, or Firm*—Lawrence J. Shurupoff

(57) ABSTRACT

In known starting devices, an individual starter is provided which accelerates the internal combustion engine to only a relatively low rotational speed at which an initial injection with subsequent combustion takes place. During a cold start of the internal combustion engine, it is therefore absolutely necessary to provide a relatively rich fuel/air mixture for the initial injection. However, this results in a situation in which, during this phase, relatively high exhaust gas emissions, in particular of hydrocarbons, are produced, which cannot be controlled by a catalytic converter which is not yet at its operating temperature. In order to reduce the exhaust gas emissions, a starting device for an internal combustion engine is proposed which has two starters for starting the internal combustion engine, a first starter being activated at the beginning of the starting process and being deactivated after a specific rotational speed of the internal combustion engine has been reached, a second starter (2) being activated. The second starter subsequently drives the internal combustion engine further to a specific setpoint rotational speed, after which, when the setpoint rotational speed has been reached, an initial injection of fuel for subsequent combustion is carried out. The starting device according to the invention is provided for internal combustion engines of vehicles.

15 Claims, 2 Drawing Sheets

FIG 5
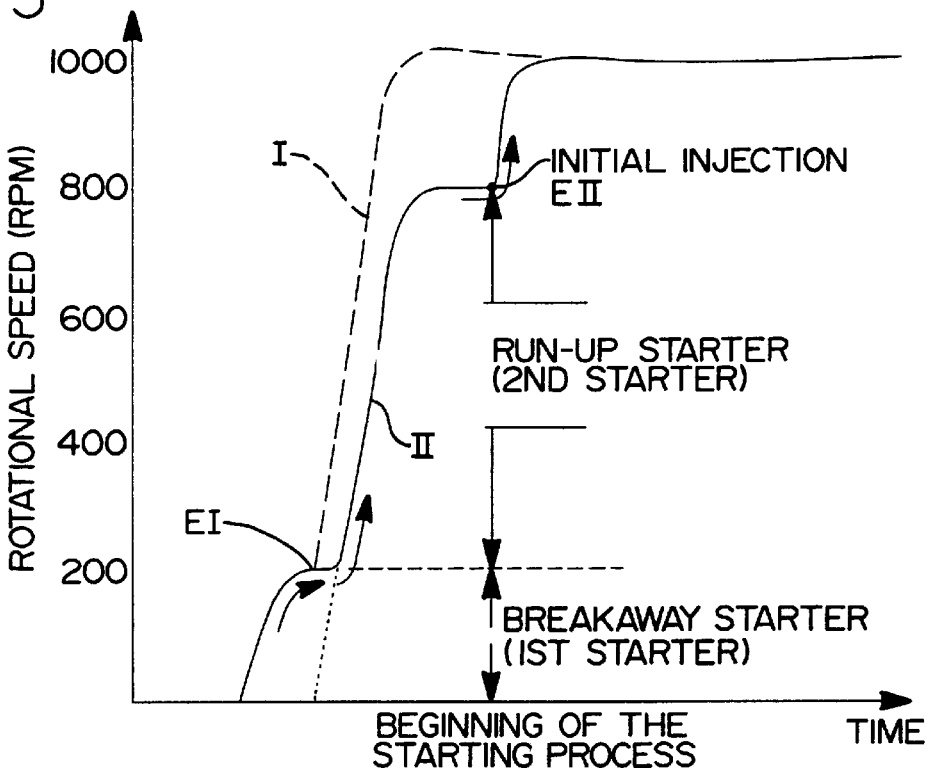
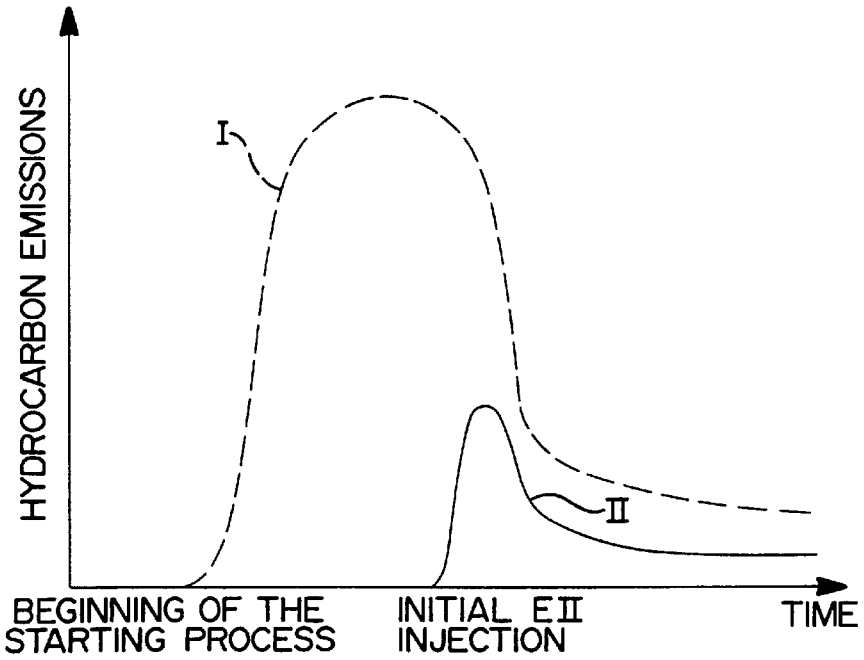
FIG 6

STARTING DEVICE FOR AN INTERNAL COMBUSTION ENGINE AND METHOD FOR STARTING THE INTERNAL COMBUSTION ENGINE

PRIOR ART

The invention relates to a starting device for an internal combustion engine and a method for starting the internal combustion engine.

The generic-type-forming JP 59-82575 A discloses that two starters are provided to start an internal combustion engine. The starters are activated here as a function of the operating temperature of the internal combustion engine, specifically in such a way that when the internal combustion engine is cold two starters carry out the starting of the internal combustion engine. When the internal combustion engine is warm, this is to be performed with just a single starter.

DE 89 14 904 U1 discloses a starter motor which serves as a generator while the internal combustion engine is operating. For this purpose, the starter motor has a two-stage planetary gear mechanism, which makes available a high torque in the first phase of the starting process and a lower torque, with a higher rotational speed, in the following starting phase.

In addition, a starting device which has a starter is known from Bosch Kraftfahrtechnisches Handbuch [Bosch Automotive Manual], 22nd Edition, 1995, VDI-Verlag [publishing house], pages 541 to 544.

The starter here is designed in such a way that a reliable cold start can be carried out even at low external temperatures (down to approximately −40° C.) For this purpose, a starter speed of at least 120 revolutions/min is usually provided for the starter. In order to be able to bring the internal combustion engine from the starter speed to the cold idling speed during the starting process, it is necessary to inject and combust a relatively rich fuel/air mixture after the starter speed has been reached. The result of this is that during this phase relatively high exhaust gas emissions, in particular of hydrocarbons, are produced, which, however, cannot be controlled by a catalytic converter which is not yet at its operating temperature. The requirements of low emission schemes, such as are prescribed in California for example, cannot therefore be fulfilled with such starters.

More recent developments, for example ISAD (Integrated Starter Alternator Damper), are characterized by particularly high-performance starter generators in which the intention is to improve the emission values by means of a raised starter speed. However, it is disadvantageous that during a cold start of the internal combustion engine, such starter generators require high voltages of, for example, 36 or 42 volts from the vehicle's electrical system.

SUMMARY OF THE INVENTION

The starting device according to the invention for an internal combustion engine has, in contrast to the above, the advantage that during a cold start of the internal combustion engine there is a significant decrease in the harmful components in the exhaust gas, in particular of hydrocarbons. This is advantageously possible without changing the conventional 12 volt electrical system of a vehicle.

BRIEF DESCRIPTION OF THE DRAWING

Exemplary embodiments of the invention are illustrated in simplified form in the drawing and explained in more detail in the following description.

FIG. 5 shows a diagram of a rotational speed profile of the internal combustion engine starting from when the internal combustion engine starts, plotted over time, FIG. 6 shows a diagram of a profile of the hydrocarbon emissions of the internal combustion engine starting from when the internal combustion engine starts, plotted over time.

DESCRIPTION OF THE EXEMPLARY EMBODIMENTS

Figure 1:
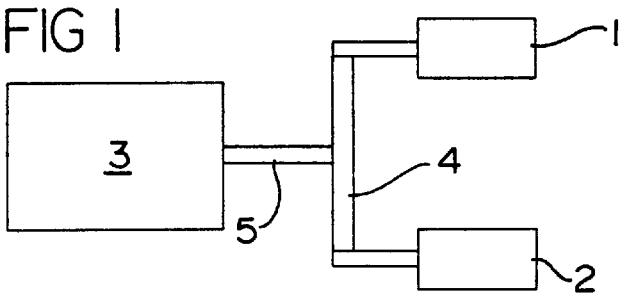
FIG. 1 shows a schematically simplified illustration of a starting device according to a first exemplary embodiment of the invention.

FIG. 1 shows a first exemplary embodiment of the invention in a schematically simplified form of illustration. A conventionally designed first starter 1 for an internal combustion engine 3 of a vehicle acts, for example, on a crankshaft 5 (drive shaft) of the internal combustion engine 3 by means of a toothing of a starter ring gear 4. In the same way, a second starter 2 acts on the starter ring gear 4. The transmission of the torque which is made available by the starters 1, 2 is carried out, for example, by means of pinions (not illustrated in more detail), which engage in a toothing (not illustrated in more detail) of the starter ring gear 4. The two starters 1, 2 are attached to one end of a crank casing (not shown in more detail) of the internal combustion engine 3 and have a free wheel, which protects the starters 1, 2 against excessively high rotational speeds when the internal combustion engine 3 is overtaking. Furthermore, the two starters 1, 2 are fed by a conventional 12 volt vehicle electrical system, for which, for example a single starter battery is sufficient. For example, a plurality of starter batteries may be provided.

According to the invention, the starting process is divided between the two starters 1, 2 in such a way that the first starter 1 starts the internal combustion engine 3 from the stationary state and accelerates it to between approximately 150 rpm and 250 rpm, preferably to approximately 200 rpm. Then, the second starter 2 takes over the task of accelerating the internal combustion engine further, the first starter 1 being deactivated. The first starter 1 is therefore dimensioned in such a way that a reliable cold start of the internal combustion engine 3 is possible down to −40° C., for example. The first starter 1 thus performs a "breakaway function" since it accelerates the internal combustion engine 3 from the stationary state, overcoming inertia and friction. The second starter 2 may be of weaker design in terms of power since it only has to ensure further running up of the internal combustion engine 3 to a predefined setpoint rotational speed of, for example, approximately 800 rpm. The second starter 2 is therefore referred to below as "the run-up starter 2". After a high rotational speed level of approximately 800 rpm has been reached by means of the run-up starter 2, an injection of fuel into combustion spaces of the internal combustion engine then takes place for the first time by means of an injection system (not illustrated in more detail) of the internal combustion engine 3. The internal combustion engine 3 is started and the combustion is thus carried out only after a relatively high rotational speed level of the internal combustion engine 3 has been reached. Owing to the division of the starting process between two starters 1, 2, it is possible to optimize them for the respective application, or construct them in a way which is adapted to it. For example, it is possible to provide, in comparison with the starter transmission ratio of 1:60 which is known from the prior art for an individual starter, a relatively high transmission ratio for the breakaway starter 1 of 1:100. A low transmission ratio of, for example, 1:20 is then sufficient for the run-up starter 2. The lower transmission ratio for the run-up starter 2 thus further improves the cold start capability. It is even sufficient, under certain circumstances, to perform a warm start of the internal combustion engine 3 using just the run-up starter 2 which is weaker in terms of power, without the breakaway starter 1.

Such a starting sequence of the internal combustion engine 3 is indicated in FIG. 5 by a line II. Here, the initial injection of fuel in FIG. 5 is indicated by EII. In comparison with this, a line I which is indicated by broken lines is plotted in FIG. 5 to show a hitherto customary starting process with just one individual starter. In the starting process known from the prior art, in accordance with broken line I, the starter accelerates the internal combustion engine to, for example only approximately 200 rpm, after which there is an initial injection fuel for subsequent combustion in combustion spaces of the internal combustion engine. This point is indicated in FIG. 5 by EI. In order to be able to ensure that the internal combustion engine is reliably started from this low rotational speed level, it is necessary to combust a rich fuel/air mixture. However, the result of this is that, during this phase, relatively high exhaust gas emissions, in particular of hydrocarbons, are produced, which cannot be controlled because the catalytic converter has not yet reached its operating temperature.

In contrast, the invention provides for the injection of fuel to be performed only at a relatively high rotational speed level of, for example between approximately 700 rpm and 1000 rpm, preferably at approximately 800 rpm. Injection or combustion of fuel at this high rotational speed level leads to a particularly good combustion with extremely low emissions, in particular of hydrocarbons. This is shown particularly clearly in FIG. 6, in which the profile of the hydrocarbon emissions output by the internal combustion engine 3 is plotted over time starting from when the internal combustion engine 3 starts. The line I indicates here a profile such as is obtained from the hitherto customary starting method according to line I in FIG. 5. The line II in FIG. 6 shows the profile of the hydrocarbon emissions such as are obtained in accordance with the inventive starting sequence according to line II in FIG. 5. As the line II shows, there is a significant reduction in the hydrocarbon emissions.

However, the starting process according to the invention is not restricted to the use of two starters. Instead of the two starters 1, 2, just a single starter may be sufficient, as is described in more detail in the further exemplary embodiments according to FIGS. 2 to 4. All parts which are identical or have an identical effect are referred to here with the same reference symbols of the first exemplary embodiment according to FIG. 1.

Figure 2:
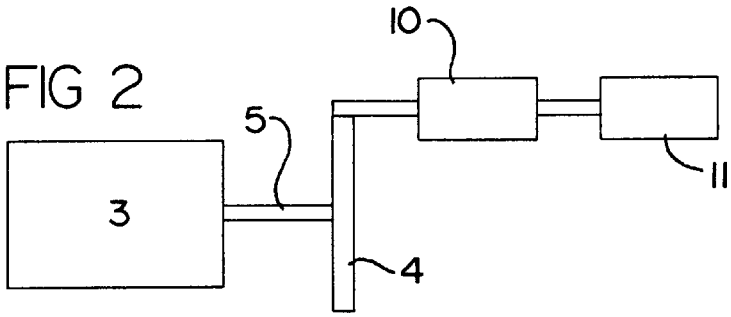
FIG. 2 shows a schematically simplified illustration of the starting device according to a second exemplary embodiment of the invention.

As is shown by FIG. 2, just a single starter 11, which is coupled to the starter ring gear 4 by means of a gear mechanism 10, is provided. The gear mechanism 10 is a continuously variable gear mechanism 10 which can continuously vary the transmission ratio between the starter 11 and the starter ring gear 4 in order to be able to correspondingly set or reduce the torque during the running up of the process. Such continuously variable gear mechanisms are sufficiently well known to the person skilled in the art under the term CVT (Continuously Variable Transmission). The torque which is output by the starter 11 by means of the gear mechanism 10 is controlled in such a way that during starting there is a high torque which continuously decreases as the rotational speed of the internal combustion engine increases. This makes it possible to carry out an initial injection of fuel at a high rotational speed level with just one starter 11.

Figure 3:
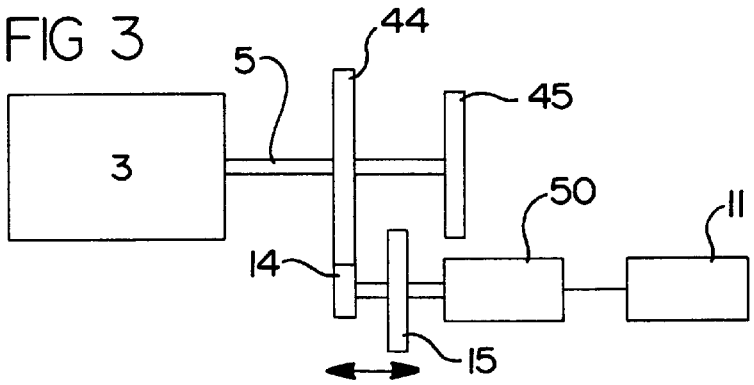
FIG. 3 shows a schematically simplified illustration of the starting device according to a third exemplary embodiment of the invention.

FIG. 3 shows a third exemplary embodiment of the invention in which there is also provision of just a single starter 11. The starter 11 has two pinions, a first pinion 14 with a smaller diameter and a second pinion 15 with a larger diameter, the first pinion 14 being able to act on a first starter ring gear 44 with a larger diameter and the second pinion being able to act on a second starter ring gear 45 with a smaller diameter. During the starting of the internal combustion engine 3 there is provision for the first pinion 14 to be able to act initially on the first starter ring gear 44 as a step-down gear mechanism with a large transmission ratio of, for example, 1:100. After a specific rotational speed of between approximately 150 rpm and 250 rpm, preferably approximately 200 rpm, has been reached, the pinion 14 is changed over, or decoupled, from the first starter ring gear 44, for example by displacing it by means of an actuator element 50 or the like, after which the second pinion 15 engages in the second starter ring gear 45. The low transmission ratio which is provided between the second pinion 15 and the second starter ring gear 45 is here, for example, approximately 1:20. However, it is also possible to use, instead of the described two-stage gear mechanism 14, 15, 44, 45, 50, a planetary gear mechanism which can preferably be integrated in the housing of the starter 11. However, it is also possible to provide a differential gear mechanism instead of the planetary gear mechanism.

Figure 4:
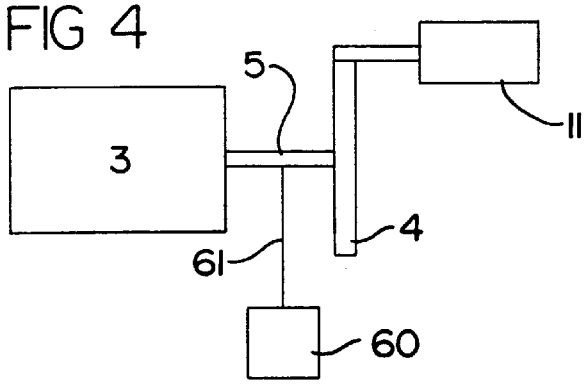
FIG. 4 shows a schematically simplified illustration of the starting device according to a fourth exemplary embodiment of the invention.

FIG. 4 shows a fourth exemplary embodiment of the invention in which there is also provision of just a single starter 11. The starter 11 is, for example, a conventional starter which, as "breakaway starter", accelerates the internal combustion engine 3 to between approximately 150 rpm and approximately 250 rpm, preferably to approximately 200 rpm. For further acceleration, there is then provision for a generator 60 (dynamo) to be used, which is mounted on the internal combustion engine 3 in a conventional way and is operated in reverse, i.e. in the opposite mode of operation so that then, coupled via a V-belt 61 for example, in its function as an electric motor or electric drive it accelerates the internal combustion engine 3 to the setpoint rotational speed of between approximately 700 rpm and approximately 1000 rpm, preferably to approximately 800 rpm. The generator 60 thus performs the function of the second starter 2 in the first exemplary embodiment according to FIG. 1.

What is claimed is:

1. Starting device for an internal combustion engine, having two starters, characterized by means for activating a first starter, means for deactivating the first starter after a specific rotational speed of the internal combustion engine has been reached, means for activating a second starter which accelerates the internal combustion engine further to a specific setpoint rotational speed, and means for initially injecting fuel to the engine when the setpoint has been reached.

2. Starting device according to claim 1, characterized in that the first starter accelerates the internal combustion engine to between approximately 150 and approximately 250 rpm.

3. Starting device according to claim 1, characterized in that the second starter accelerates the internal combustion engine to the setpoint rotational speed of between approximately 700 rpm and approximately 1000 rpm.

4. Starting device according to claim 1, characterized in that the two starters are attached to one end of a crank housing of the internal combustion engine and engage in a toothing of a starter ring gear of the internal combustion engine.

5. Starting device according to claim 1, characterized in that both starters have a free wheel.

6. Starting device according to claim 1, characterized in that the first starter is coupled to the internal combustion engine with a significantly higher transmission ratio than the second starter.

7. Starting device according to claim 6, characterized in that the transmission ratio of the first starter is approximately 1:100, and the transmission ratio of the second starter is approximately 1:20.

8. Starting device according to claim 1, characterized in that the starting process is a cold start of the internal combustion engine.

9. Starting device according to claim 1 characterized in that the first starter accelerates the internal combustion engine to approximately 200 rpm.

10. Starting device according to claim 1 characterized in that the second accelerates the internal combustion engine to the setpoint rotational speed of approximately 800 rpm.

11. Method for starting an internal combustion engine, having two starters, comprising the steps of at the beginning of the starting process activating a first starter, deactivating the first starter after a specific rotational speed of the internal combustion engine has been reached, and then activating a second starter, which accelerates the internal combustion engine further to a specific setpoint rotational speed, after which, when the setpoint rotational speed has been reached, carrying out an initial injection of fuel for subsequent combustion.

12. Method according to claim 11, characterized in that the first starter accelerates the internal combustion engine to between approximately 150 to approximately 250 rpm.

13. Method according to claim 11, characterized in that the second starter accelerates the internal combustion engine to the setpoint rotational speed of between approximately 700 rpm and approximately 1000 rpm.

14. Method according to claim 11, characterized in that an initial injection of fuel with subsequent combustion takes place in the range between approximately 700 rpm and approximately 1000 rpm.

15. Method of claim 11 wherein the starting process is a cold start of the internal combustion engine.

* * * * *